United States Patent [19]

Rozenblad

[11] 4,351,525

[45] Sep. 28, 1982

[54] MULTIPLE USE EXERCISING DEVICES

[76] Inventor: William L. Rozenblad, 401 W. 56th St., New York, N.Y. 10019

[21] Appl. No.: 236,830

[22] Filed: Feb. 23, 1981

[51] Int. Cl.[3] ..... A63B 21/00

[52] U.S. Cl. ..... 272/93

[58] Field of Search ..... 272/62, 111, 63, 144, 272/93, 126, 109; 248/363; 15/105.5, 104.94, 253; 7/167

[56] References Cited

U.S. PATENT DOCUMENTS

| | | | |
|---|---|---|---|
| 1,761,109 | 6/1930 | Dietz | 15/235.4 |
| 2,259,653 | 10/1941 | Mitchell | 15/235.4 |
| 2,634,077 | 4/1953 | Van Dusen | 248/363 X |
| 3,115,338 | 12/1963 | Acs et al. | 272/126 |
| 3,180,604 | 4/1965 | Hammer | 248/363 X |
| 3,572,701 | 3/1971 | Agamian | 272/126 |
| 3,664,667 | 5/1972 | McCarthy | 272/126 X |
| 3,686,703 | 8/1972 | Ray | 15/235.4 |
| 4,046,373 | 9/1977 | Kim | 272/63 |

*Primary Examiner*—Richard C. Pinkham
*Assistant Examiner*—William R. Browne

[57] ABSTRACT

An exercise device having one or two wood plaques with relatively flat, inverted U-shaped members extending vertically upright thereon. The U-shaped members are tubular and include horizontal portions with ends thereon extending downwardly into the plaques which serve as bases. Internal members in the ends include projections extending through the bases and engaged by locking members countersunk into the bases. The locking members are covered by non-skid mats. Collars encircle the aforementioned ends to aid in holding the U-shaped members upright.

3 Claims, 5 Drawing Figures

U
10
12
14
16
18
20
22
24
26
28

30
32
40
42
44
46
48
50
56
60
T

L
W
10
30
32
37
38
56
58

MULTIPLE USE EXERCISING DEVICES

FIELD OF INVENTION

This invention relates to exercising apparatus and, more particularly, to devices adapted for use singly or in combination and for dynamic exercises as well as isometric exercises.

BACKGROUND

Exercise is any type of physical activity that employs the muscles of the body. Exercise may be provided by sports or by home activities and the like but there are more formal types of exercises which require running, jumping, throwing, squatting, lifting and pushing movements as well as other movements which cause the muscles to be worked. Exercise is important in developing the muscles of the body as well as to maintain the body in good physical condition. Exercise aids health by improving various body functions including breathing, blood circulation, digestion and so forth. It is also believed that exercise improves mental health.

Numerous types of exercising devices are well known. Some of these devices, insofar as they may relate to the present invention, are shown in U.S. Pat. Nos. 2,666,640; 3,144,545; and 3,540,724.

In U.S. Pat. No. 2,666,640 K. L. Jennings discloses an exercising stand consisting generally of a pair of inverted U-shaped frames each having a front leg and a rear leg the two front legs being rotatably received in elongated bearing and thrust resisting sleeves carried by the ends of a horizontal thrust resisting bar arranged at a distance above the lower ends of the front legs. This positions the bearing and thrust sleeves near the medial portions of the two front legs to prevent outward bending, tilting and the spreading of the end frames caused by outward thrusts exerted upon these frames from a point therebetween. This device is useful insofar as it pertains to constituting an exercising stand for dynamic exercises, however, this type of apparatus finds no use in connection with isometric exercises.

C. L. Horn discloses in U.S. Pat. No. 3,114,545 a collapsible and adjustable head stand apparatus which consists of three main pieces all of which are essentially flat and may be packed into a relatively thin carrying case. The three pieces are assembled into a head stand by means of two telescoping joints and two specially designed screw threaded couplings. This type of apparatus is intended for a relatively specific type of exercise operation and is not useful in connection with isometric exercises.

In U.S. Pat. No. 3,540,724 W. Hunter discloses a multi-positionable exercising device comprising a frame including parallel side bars adapted at the ends thereof to be jointly releasably joined to the connecting portions of a U-shaped end piece alternatively in either co-planar or angularly related relationship. An endless band of resilient material may be used with the device to provide a yieldable resistance to movement of selected parts of the exercising device. This apparatus is also not utile in connection with isometric exercises as will be disclosed in greater detail hereinunder.

SUMMARY OF INVENTION

It is an object of the invention to provide an improved exercising apparatus.

It is another object of the invention to provide an improved exercising apparatus having advantages over those exercising devices heretofore known.

It is still another object of the invention to provide an improved exercising apparatus adapted for use singly or in multiple combinations and as well for dynamic exercises or isometric exercises selectively or in combination.

In achieving the above and other objects of the invention there is generally provided a structure comprising at least one support in turn comprising a base and a generally U-shaped member having two ends mounted on the base, said U-shaped member being in generally upright inverted attitude on the base. In the preferred arrangement there is provided no more than one U-shaped member on each such base and the base is preferably flat and may extend over an area of approximately 50 to 150 square inches. The base, moreover, may have a thickness generally within the range of from ½ to 1½ inches. Furthermore, the base may be of wood although it is also possible to fabricate the base of metal, plastic and other suitable materials.

The base is preferably of a flat configuration in the form of a plaque and the U-shaped member mentioned hereinabove may be of tubing having a diameter of about 1 to 2 inches. This U-shaped member may include a horizontal portion mounted at about 3 to 6 inches above the associated base. This horizontal portion is preferably in the range of about 10 to 12 inches long.

In accordance with a feature of the invention there are provided relatively flat conical shields or collars encircling each of the ends of the U-shaped mambers and these collars are positioned against the base to prevent the U-shaped members from tilting relative to the associated base. As a still further feature of the invention non-skid or anti-skid mattings may be provided on the bottoms of the bases.

In accordance with a preferred embodiment of the invention two such supports are employed in spaced and parallel relationship, thus providing for exercises such as push-ups wherein the body is raised and lowered intermediate the two spaced supports. The invention has many other uses however, such as, for example, one of a set of the two supports may be utilized at one time with one or both hands of the user engaging the inverted U-shaped member to provide for an alternate form of exercise. Still further since the devices of the invention are portable they may be used in cooperation with one another with the bases being placed in opposition to one another in face-to-face relationship with the U-shaped members providing grips for the hands thereby to provide a basis for isometric exercises in such a manner as to provide a substantial improvement over the previously known devices by affording a whole new range of types of exercise.

According to another aspect of the invention the abovementioned U-shaped members are tubular and the aforesaid ends extend into the flat wood base. Internal elements are provided in the ends and include projections extending at least partly through the base, there being provided locking mechanisms on the projections to clamp the U-shaped member to the base. These locking members may be preferably countersunk into the base and there may be provided non-skid mats which cover the locking members. In addition thereto collars may be provided on the ends and against the base to aid in holding the unshaped member in upright position on the associated base.

Other objects, features and advantages of the invention will be found in the detailed description which follows hereinafter as illustrated in the accompanying drawing.

DETAILED DESCRIPTION

Figure 1:
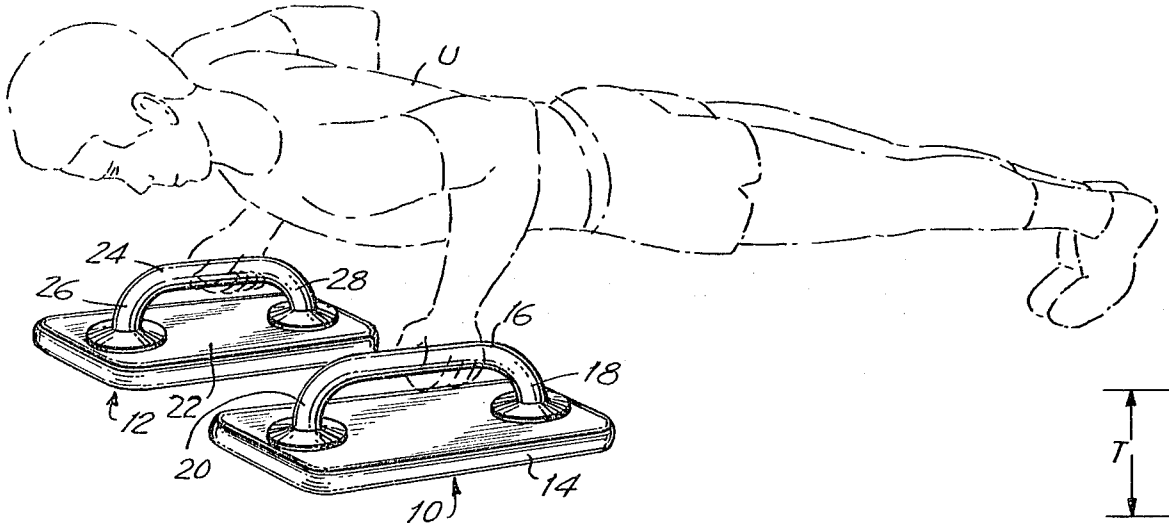
FIG. 1 is a perspective view partially in phantom lines illustrating the utility of two devices provided in accordance with the invention.

The device of the invention is intened to develop the upper body by the expedient of providing for push-up type exercises and the like. The apparatus of the invention primarily develops the chest, shoulders, neck, triceps and abdominal muscles. Moreover the apparatus of the invention provides for vascular system strengthening devices. The device of the invention can be used singly or in pairs. The device provides for exercises which are substantially strenuous but the performance of which is made more difficult by the use of a single device with both hands being applied to the device which is used alone rather in pairs as illustrated in FIG. 1. The device of the invention is a relatively simple device which can be manufactured with mass production techniques at relatively low cost thereby to be made readily available to both adults and children for use in the convenience in one's own room, apartment or house. As noted hereinabove, the device of the invention can be used in pairs or singly in association with isometric exercises. By way of example, the bases of two devices can be placed in opposed face-to-face relationship thereby affording a convenient arrangement for isometric exercises pitting the muscles of one arm against the muscles of the other arm. Similarly, the flat base of the invention can be utilized by being placed against walls or other such structural elements to permit the utilization of the muscles in isometric exercises adapted to build up the same and create other helpful stress situations.

In FIG. 1 appear two devices of the invention notably those indicated at 10 and 12. Device 10 includes a base 14 and a generally U-shaped member 16 which is in generally vertical attitude and in inverted relationship. The ends 18 and 20 of the U-shaped member 16 extend into the base 14 as will be described in greater detail hereinafter. Similarly, device 12 is provided with a base 22 whereupon is mounted in upright attitude an inverted U-shaped member 24 having ends 26 and 28 extending into the base 22.

As appears in FIGS. 2–5 a single device of the invention may be provided generally with a wooden base 30 which is of flat form having a thickness T preferably in the range of $\frac{1}{2}$ to $1\frac{1}{2}$ inches. The base is preferably of rectangular shape and has a length L which is substantially greater than the width W. By way of example, the base may preferably be 7 inches wide and 14 inches long, with the thickness of about 1 inch. The base will preferably cover an area of approximately 50 to 150 square inches with a preferable exemplary area being in the order of 100 square inches thereby to permit the forces exerted on the exercising devices to be evenly distributed to a supporting structure without damaging the same.

Figure 4:
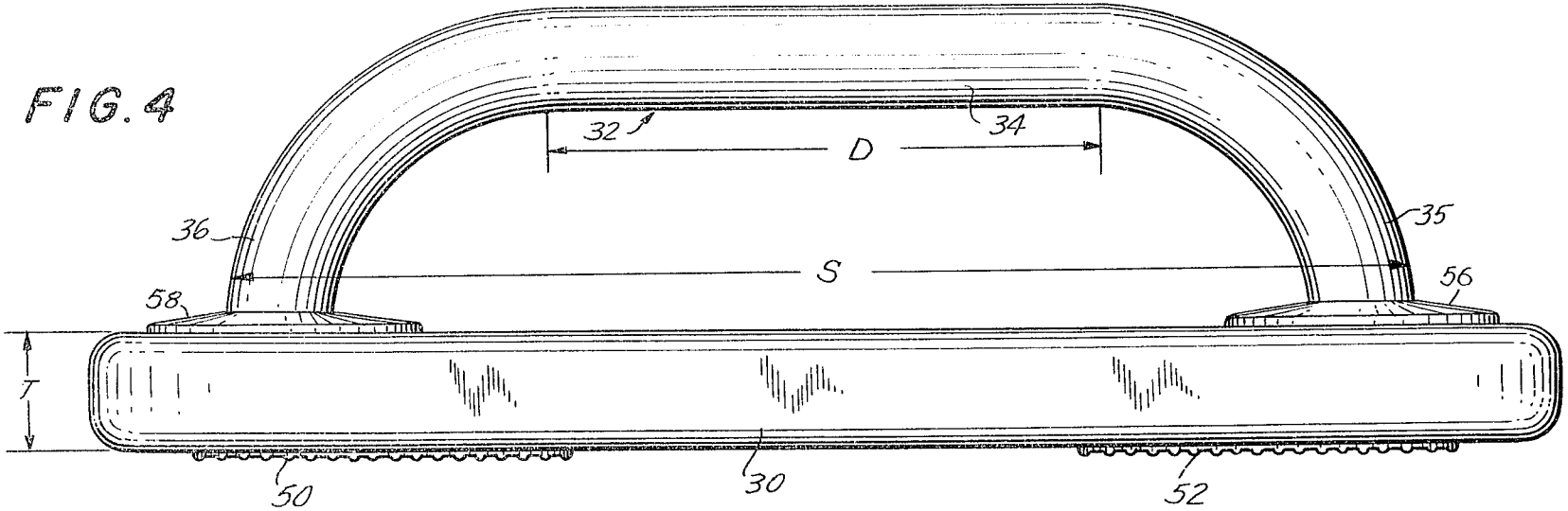
FIG. 4 is a side view of the exercising device.
Figure 5:
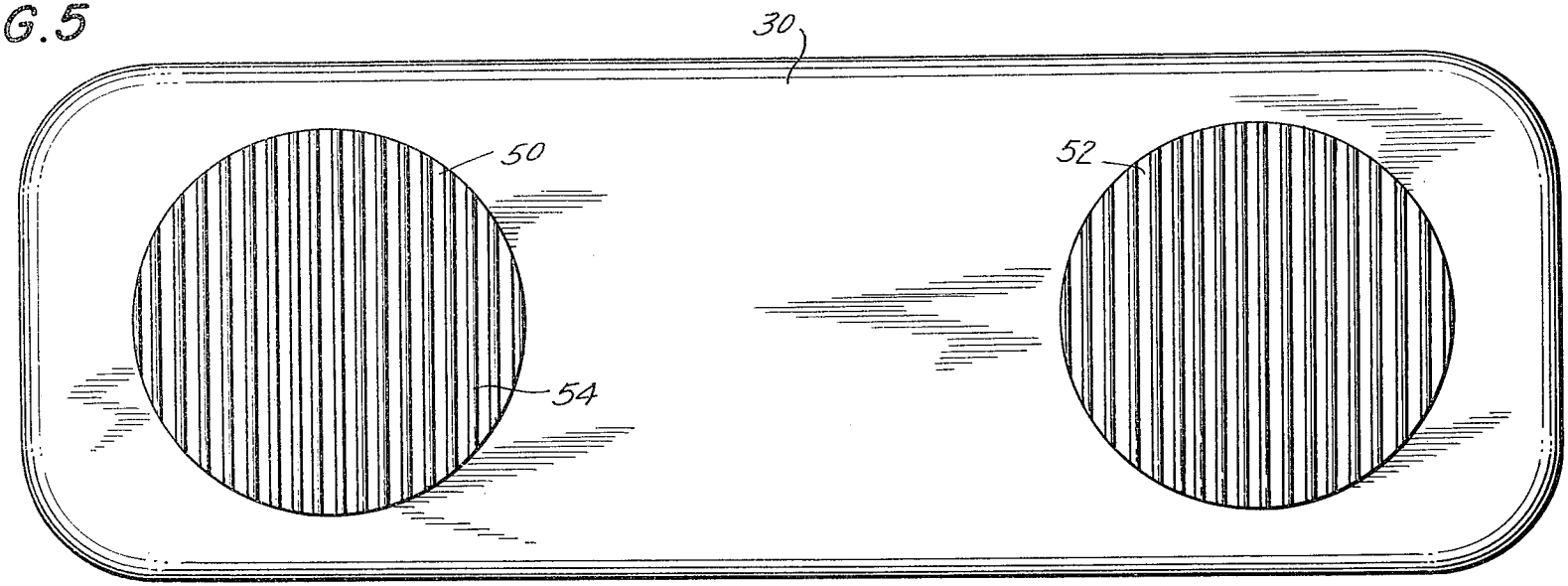
FIG. 5 is a botton view of the exercising device of the invention.

On top of the base 30 is mounted, as mentioned above, a U-shaped member 32. The U-shaped member 32 is preferably fabricated of a stainless steel tubing or of an enameled steel tubing having a diameter which is preferably in the order 1 to 2 inches. Smaller tubing may be employed as has been the case with devices heretofore known, but in the nature of the invention the tubing is preferably within the indicated range to afford a preferred engagement by the hands of the operator. The grip 32 as illustrated in FIG. 4 consists of a horizontal elongated portion 34 the length of which is indicated at D. The total length of the U-shaped member is indicated at S. The dimension S is preferably in the order of 10 to 12 inches long. The length D is preferably of the order of magnitude of 5 to 8 inches long.

End portions 35 and 36 are preferably quarter-circular in shape. The diameter of each of these portions is preferably the same so that the U-shaped member is symmetrical. The diameter or radius of these members is such as to merge smoothly into the horizontal portion 34 while extending vertically into the associated base 30.

While the U-shaped member 32 is preferably fabricated of metal, the base 30 is preferably fabricated of a hard wood such as solid maple or oak. The corners of the base such as indicated at 37 are preferably rounded as are the edges 38. The base 30 presents no sharp edges or corners to the user of the device. The surface of the base is furthermore preferably finished with several coats of urethane varnish to a satin finish and all zones at which a splintering of the wood might otherwise occur are protected by suitable hardware or mats or the like as will become more apparent hereinafter.

Figure 3:
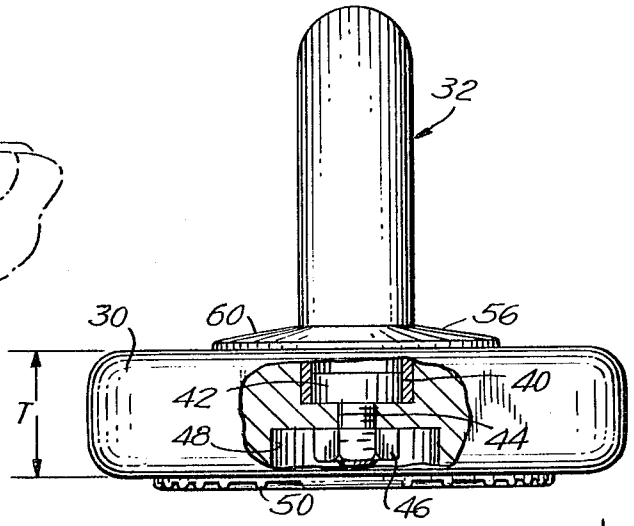
FIG. 3 is an end view thereof partially broken away for showing concealed structures.
Figure 2:
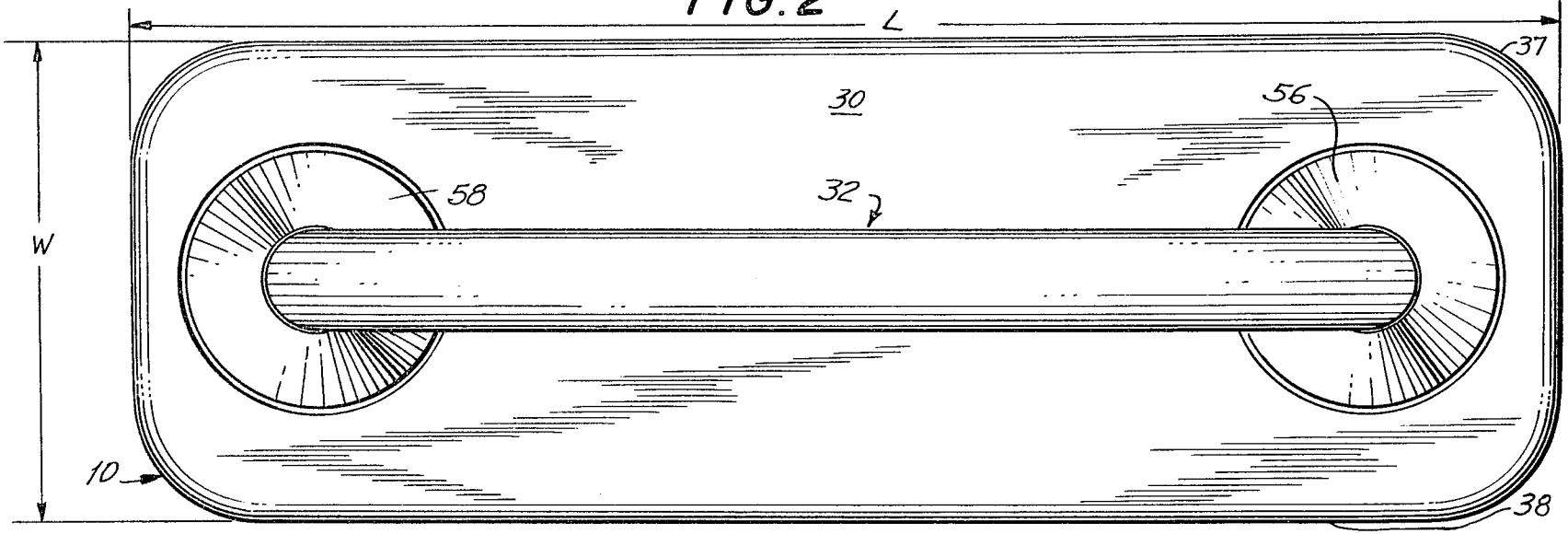
FIG. 2 is a top view of one of the exercising devices of FIG. 1.

The ends of the inverted U-shaped member 32 extend into the base 30 so that member 32 constitutes a handgrip firmly fixed to the base by means of hardware at least partly concealed within the tubing constituting the member 32. FIG. 3 shows one of the ends exposed by way of example. Therein can be viewed the end 40, the bore of which accommodates an internal element 42 welded or otherwise secured in the bore by means of an adhesive or the like and supporting a projection 44 extending at least partly through the base 30 via an opening formed therein. The end of projection 44 is in the illustrated embodiment threaded and this end is engaged by a locking member 46 in the form of a nut or the like. The nut 46 is received in a depression 48 and is therefore in countersunk relationship to the base 30. The depression or opening 48 is covered by an anti-skid or non-skid mat 50 which is one of two mats the other being indicated at 52. Mats 50 and 52 are ribbed mats including ribs 54. The mats 50 and 52 cover the associated openings thereby concealing the aforesaid hardware and being in registration with the end portions 35 and 36. Therefore the bulk of the forces vectored through end portions 35 and 36 will be driven into the mats 50 and 52 thereby providing for firm grippage on a supporting surface.

Encircling each of the end portions are collars 56 and 58. Each collar has a truncated conical surface 60 and is in encircling relationship with the associated end portion. Each collar, moreover, is in facing possibly countersunk relationship against the top of the associated U-shaped member in vertical attitude despite forces which might tend to tilt the same relative to the associated base.

From what has been stated hereinabove, it will now be understood that the devices of the invention are structurally sound and strong members permitting their use in paris as illustrated in FIG. 1 wherein the user indicated generally at U grasps the U-shaped members in his hands, the devices being arranged in spaced and parallel relationship. The user is thereby enabled to do push-ups with his body being brought to a position intermediate the spaced devices. It is of course possible to use these devices in a manner whereby they are angularly offset from one another thereby to accommodate particular body configurations and strength, and also to permit a variation on the exercises performed. In addition, it is possible to use only one such device whereby the inverted U-shaped member thereof is engaged by both hands of the user who then manipulates himself in exercising performance with the use of a single device rather than two devices in the spaced and parallel relationship which has been illustrated.

In addition to the above it is possible to bring the flat planar bottom faces of two such devices into facing and opposed relationship. The U-shaped members in such an arrangement extend in opposite directions and may be grasped by the respective hands of the user. In this case, the apparatus constitutes an isometric device for relevant exercises thereby greatly extending the field of use of the apparatus of the invention. In addiiton the flat bottom faces of the respective devices may be placed against supporting or resisting structures such as a wall of a dwelling or room or the like with, once again, the devices providing for isometric exercises of a type not possible with those devices heretofore known and discussed hereinabove.

There will now be obvious to those skilled in the art many modifications and variations of the construction set forth hereinabove. These modifications and variations will not depart from the scope of the invention if defined by the following claims directly or by interpretation.

What is claimed is:

1. An exercising structure comprising at least one support, said support comprising a base and a generally U-shaped member having two ends mounted on said base, said U-shaped member being in generally upright inverted attitude on said base, said U-shaped member being tubular and said ends extending into said base, said structure further comprising internal elements in said ends and including projections extending at least partly through said base and locking members on the projections to clamp said U-shaped member to said base.

2. A structure as claimed in claim 1, wherein said locking members are countersunk onto said base, comprising non-skid mats cover said locking members.

3. A structure as claimed in claim 2 comprising collars on said ends and against said base to aid in holding the U-shaped member in upright position on said base.

* * * * *